US005819337A

United States Patent [19]

Bergmann

[11] Patent Number: 5,819,337

[45] Date of Patent: Oct. 13, 1998

[54] LINK JOINT

[75] Inventor: Konrad Bergmann, Mosel, Germany

[73] Assignee: Ideal-Standard GmbH, Bonn, Germany

[21] Appl. No.: 793,061

[22] PCT Filed: Jul. 31, 1995

[86] PCT No.: PCT/DE95/01031

§ 371 Date: Mar. 27, 1997

§ 102(e) Date: Mar. 27, 1997

[87] PCT Pub. No.: WO96/04432

PCT Pub. Date: Feb. 15, 1996

[30] Foreign Application Priority Data

Aug. 2, 1994 [DE] Germany ..... 44 28 840.9

[51] Int. Cl.[6] ..... E03C 1/232

[52] U.S. Cl. ..... 4/684; 403/400

[58] Field of Search ..... 4/684, 685, 688–693; 403/388, 400, 395, 396, 346

[56] References Cited

U.S. PATENT DOCUMENTS

| | | | |
|---|---|---|---|
| 948,033 | 2/1910 | Allingham | 4/689 |
| 1,597,459 | 8/1926 | Muend | 4/691 |
| 3,169,254 | 2/1965 | Lantz et al. | 4/692 |

FOREIGN PATENT DOCUMENTS

| | | | |
|---|---|---|---|
| 78 29 075 | 2/1979 | Germany . | |
| 3039042 | 5/1982 | Germany | 4/688 |
| 3039042C2 | 5/1982 | Germany . | |
| 4037844A1 | 6/1992 | Germany . | |
| 0207132 | 11/1923 | United Kingdom | 403/395 |
| 926154 | 2/1961 | United Kingdom . | |

*Primary Examiner*—Charles E. Phillips
*Attorney, Agent, or Firm*—Michael J. Striker

[57] ABSTRACT

The object of reducing the assembly costs in the course of producing an adjusted, angularly movable coupling between a pull rod and a plunger rod by means of a constructively further improved link joint, as well as the production costs for the connecting element itself, is attained in that the has a connecting element formed as a one-piece shaped body, which encloses the pull rod and the plunger rod in the manner of a cage and is made of plastic, in which the passages for receiving the pull rod and the plunger rod are arranged in such a way that both rods rest against each other with their external surfaces. The pull rod and the plunger rod are clamped together at their intersecting point by a clamping screw and the plunger rod is additionally clamped with the shaped body in a manner which assures their position.

3 Claims, 2 Drawing Sheets

LINK JOINT

BACKGROUND OF THE INVENTION

The invention relates to a link joint for drain fittings with a pull knob for wash stands, bidets or similar plumbing fixtures for making an adjustable connection between the pull rod for actuating the closing member in the drain fitting and the plunger rod.

Wash stands, bidets or other plumbing fixtures of a higher standard and increased operating ease are supplied with drain fittings whose closing member can be moved into an open and closed position by means of a plunger rod, which in most cases is a component of a single outlet combination tap. In this case the pull rod and the plunger rod are connected by link elements so they are movable at an angle. These link elements must be adjustable and arrestable on the pull rod and on the plunger rod in order to assure the total functional capability of the closure device and an exact adaptation of the actuating device, consisting of the pull rod, the link element and the plunger rod, as a function of the conditions at the installation site following installation or following repairs to the plumbing fixture. It must furthermore be assured that the pull rod in the link and connecting element cannot be rotated around its own axis or even pulled out of the connecting element during actuation. To meet these requirements, a link joint in accordance with the species - DE 78 29 075 U1—consists of several partial elements, which are clamped on the pull rod by means of an attachment screw, wherein the plunger rod and the pull rod are connected with each other by means of a joint. This type of a link joint meets the requirements regarding dependable functioning of the drain fittings, however the outlay for these link elements on the manufacturing as well as the installation side is comparatively great.

Other designs for producing an adjustable connection between the pull rod and the plunger rod use resiliently embodied clamping pieces made of sheet metal, wherein the connecting element is a U-shaped resilient clasp with slit-shaped openings cut into the legs for receiving the pull rod. So-called tabs are provided in the bar portion of the U-shaped clasp, which are used for receiving and exactly fixing the plunger rod in place - DE 40 37 844 A1, DE 30 39 042 C2. Handling and mounting these connecting elements is extremely simple. The outlay in production technology is relatively high, even though some of these are connecting elements embodied as single pieces, in particular if it is intended to achieve the clamping between pull rod and plunger rod by means of resiliently embodied elements. In addition, there is the danger of injury in connection with such clamping elements formed of U-shaped bent clasps or which operate by means of sheet metal pieces. It is possible, for example in connection with cleaning operations of the plumbing fixtures, that the adjusted setting can be very quickly inadvertently changed, which is aided by slackened or too weak spring forces.

A clamp-like coupling element is known from GB 926 154 for clamping and fixing in respect to each other rods and tubes of lab equipment, whose longitudinal axes cross, when setting up a test arrangement in a lab. Sections of at least one of the intersecting lab elements are enclosed by the clamp, while the other equipment piece rests against the enclosed element with its exterior surface. The elements to be connected with each other are clamped together at the point of their crossing by means of a clamping screw, which is a part of a clamp-like connecting element and is screwed into a bridge element which connects both halves of the clamp.

Only a solid, rigid connection between the equipment used in the lab, such as rods and tubes, is possible with the proposed solution in accordance with GB 926,154. A relative movement of the clamped parts in respect to each other, such as is necessary, for example with a plunger rod and a pull rod, because of their function, cannot be realized with this solution.

A U-shaped block of plastic, which has two crossing bores for receiving the rods, is provided in accordance with DE-GM 78 29 075 for the hinged connection between two crossing rods or bars. The hinged connection is made possible by means of a pivotably designed part of the plastic block, which is hinged by means of a film hinge which can be elastically deformed by bending and has the receiving bore for one of the rods to be connected. Securing in place and adjusting of this hinged connection is performed with the aid of clamping screws, using a U-shaped clamping device. This hinged connection meets the functional requirements made on a connection between pull rod and plunger rod, but the plastic block is relatively expensive in regard to mounting and its own manufacture.

SUMMARY OF THE INVENTION

It is therefore the object of the invention to provide a further improved joint element of the type mentioned at the outset, which has only one screw location, and can be produced and mounted with little effort.

In keeping with these objects and with others which will become apparent hereinafter, one feature of the present invention resides, briefly stated, in a link joint, in which the connecting element is a cylindrically shaped body which encloses the pull rod and the plunger rod in a connecting region from all sides and has a head piece having a set screw, the set screw and the shaped body securing the rods against relative lateral movement, the outer surface areas of the pull rod and the plunger rod rest against each other at their intersection point which: constitutes a rotation point around which the pull rod and the plunger rod can be pivoted with respect to each other and clamped against each other at the intersection point secured in their position by means of the clamping screw, and the plunger rod is clamped additionally with the shaped body, the passage for the plunger rod has recessed sections at ends of the passage and also has cradle sections located opposite each other in the area of the central axis of the shaped body to support turning of the plunger rod in a horizontal plane.

Together with the employment of the associated connecting element, which is preferably made of plastic of suitable rigidity and which can be produced cost-effectively by means of an injection molding process, the link joint in accordance with the invention permits a rapid and secure connection between the pull rod and the plunger rod with a minimal assembly effort, since only a single screw location is provided.

While the pull rod is fixed secure against relative rotation in the shaped body, the required free space which permits a pivot movement of the plunger rod within an angular range of, for example, ±20° for assuring the opening and closing function of the closure element, is provided by recessed or slanted front sections of the passage for the plunger rod. Both rods can be moved in respect to each other within this angular range, even though they are clamped to each other. The link joint is not, loosened even after many actuations. Instead, minimal wear occurs on the pull rod and plunger rod in the area of the crossing point because of the many pivot movements. The minimal contact surfaces created in the course of this lead to a sort of interlocking connection, which securely maintains the connection between the pull rod and the plunger rod.

The clamping screw is preferably provided with a conical tip which, in the course of the mutual connection of the pull rod, plunger rod and shaped body, penetrates the pull rod in an interlocking manner. Pull-out or a rotation of the pull rod in the shaped body is assuredly prevented, even the clamping force should be slightly reduced if because of the material.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
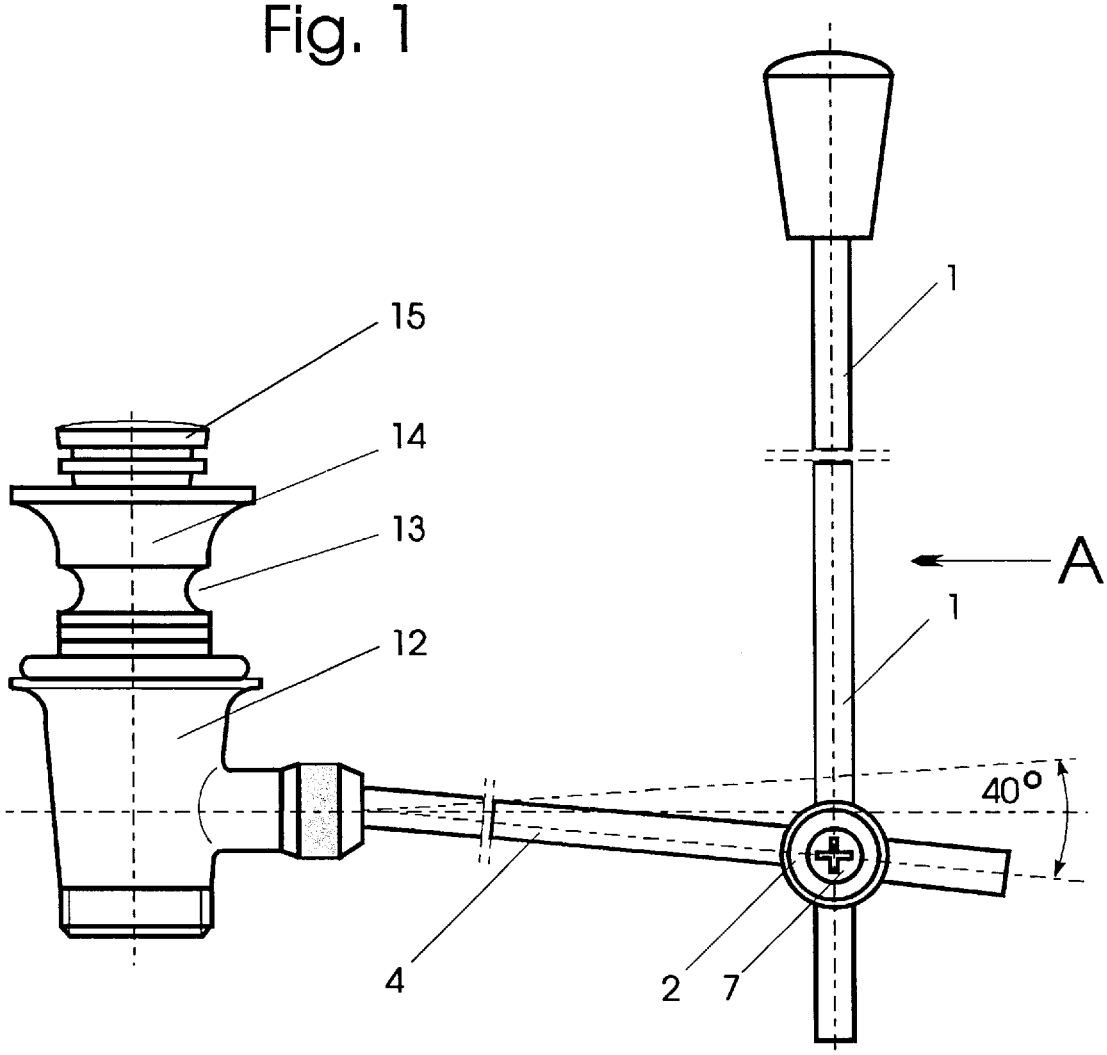
FIG. 1, a schematic representation of the drain fittings and of the connection between the pull rod and the plunger rod, using a connecting element in accordance with the instant invention.
Figure 2:
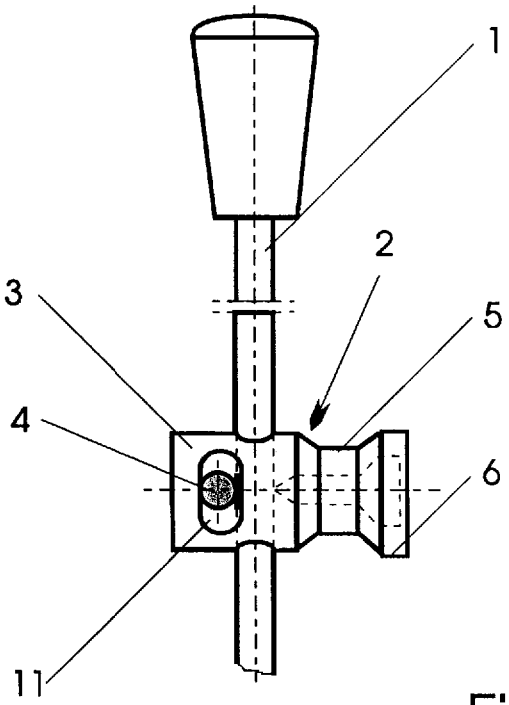
FIG. 2, the view of the connection between the pull rod and the plunger rod in the direction A in FIG. 1.
Figure 3:
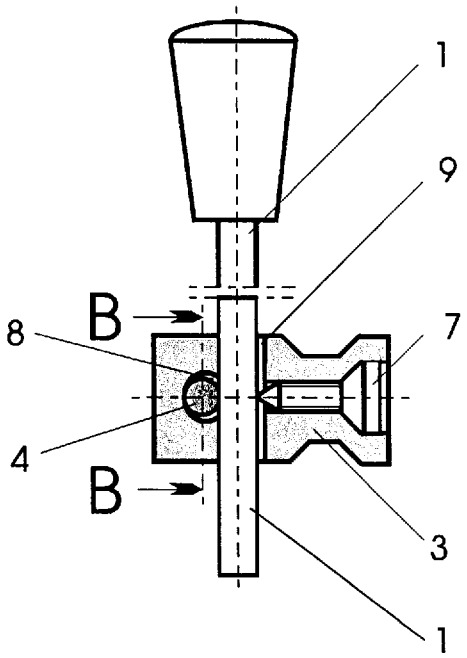
FIG. 3, the section through the shaped body with the clamping screw inserted and the pull rod and plunger rod conducted through it.
Figure 4:
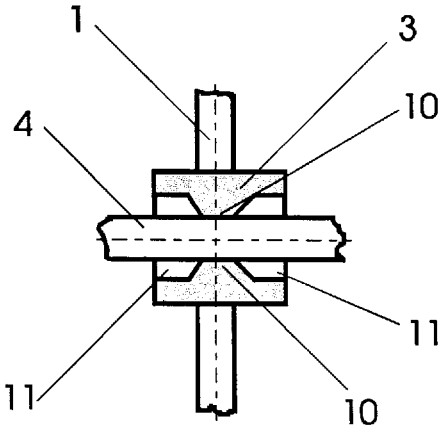
FIG. 4, the section B—B in FIG. 3.

As can be seen in FIG. 1, the pull-knob drain fittings consist of the drain element 12 with the circumferential drain recess 13, which is connected with the overflow of the plumbing fitting, and the drain cup 14, in which the closure element 15 is arranged. The closure element 15 is operatively connected with the plunger rod 4 which, in turn, is coupled, movable over an angular range of ±20°, via the connecting element 2 and the inserted clamping screw 7 with the pull rod 1, which is at least a component of a single outlet combination tap.

The connecting element 2, which is used for the angularly movable coupling of the pull rod 1 with the plunger rod 4, advantageously is a shaped body 3 made of a plastic of appropriate rigidity.

Two passages 8, 9, which are located approximately at right angles to each other, are provided in a manner known per se in the shaped body 3 and are arranged in such a way that the exterior surfaces of the pull rod 1 and the plunger rod 4 are in contact with each other and that areas of the rods 1, 4 are enclosed in the shaped body 3.

A receiver 5 with a head piece 6 is formed on the shaped body 3, into which the clamping screw 7, which has a cone-shaped tip, is screwed.

After the plumbing fixture, the single outlet combination tap and the pull-knob drain fittings have been installed, the plunger rod 4 and the pull rod 1 are inserted into the passages 8 and 9 provided for this, and both rods are clamped together at their intersection point with the aid of the clamping screw 7, wherein the cone-shaped tip of the clamping screw 7 penetrates into the surface of the pull rod and, in the course of the mutual clamping of the pull rod and plunger rod 1, 4, simultaneously clamps the plunger rod 4 together with the shaped body 3 of the connecting element. The mutual clamping between the shaped body 3, the plunger rod 4 and the pull rod I assures a positionally correct fixation of the adjusted setting of the closure element 15 in its open and closed positions. At the same time the tip of the clamping screw 7 penetrating the pull rod 1 assures that the pull rod cannot be pulled out.

The recessed or slanted sections 11 in the front of the passage 8 for receiving the plunger rod 4 assure the required free space for the unhampered pivoting of the plunger rod 4 within the mentioned angular range.

The proposed attainment of the object leads to a further reduction of the production and assembly costs of the angularly movable coupling between the plunger rod and the pull rod. Furthermore, the connecting element 2 in accordance with the invention can be handled in a very practical manner during assembly, since it is necessary to make only a single screw connection.

I claim:

1. A link joint for a drain fitting of a receptacle having a pull knob for making an angularly movable connection between a pull rod of the drain fitting and a plunger rod of a closure element of the drain fitting, the link joint including a single-piece connecting element having two passages which are arranged at approximately a right angle with each other for receiving the pull rod and the plunger rod; a clamping screw fixing an adjusted setting between the pull rod and the plunger rod so as to prevent relative lateral movement of said rods, said connecting element being a cylindrical shaped body adapted to enclose the pull rod and the plunger rod in a connecting region from all sides and provided with a head piece, said shaped body having passages arranged so that outer surface areas of the pull rod and the plunger rod are restable against each other at an intersection point which constitutes a rotation point around which the pull rod and the plunger rod are pivotable with respect to each other, said clamping screw being housed in said head piece and adapted to clamp the pull rod and the plunger rod against each other at the intersection point to secure positions of the pull rod and the plunger rod, with the plunger rod being clampable additionally with said shaped body, said passage for the plunger rod having ends provided with recess sections and also having an area of a central axis of said shaped body provided with cradle sections for turning of the plunger rod in a horizontal plane.

2. A link joint as defined in claim 1, wherein said shaped body has a receiver which ends with said head piece, said clamping screw being inserted in said receiver.

3. A link joint as defined in claim 1, wherein said shaped body is composed of a plastic.

* * * * *